US006182368B1

(12) United States Patent
So

(10) Patent No.: US 6,182,368 B1
(45) Date of Patent: Feb. 6, 2001

(54) CAN OPENER

(75) Inventor: Kwok Kuen So, Kowloon (HK)

(73) Assignee: Ki Mee Kitchenware, Ltd., Kowloon (HK)

( * ) Notice: Under 35 U.S.C. 154(b), the term of this patent shall be extended for 0 days.

(21) Appl. No.: 09/123,561

(22) Filed: Jul. 29, 1998

(30) Foreign Application Priority Data

Jul. 30, 1997 (GB) ..... 9716102

(51) Int. Cl.[7] ..... B67B 7/72
(52) U.S. Cl. ..... 30/418; 30/426; 30/416
(58) Field of Search ..... 30/418, 417, 425, 30/426, 427

(56) References Cited

U.S. PATENT DOCUMENTS

| | | | | |
|---|---|---|---|---|
| D. 289,365 | * | 4/1987 | Lee | D8/41 |
| D. 410,180 | * | 5/1999 | So | D8/39 |
| 1,628,080 | * | 5/1927 | Van Leunen | 30/418 |
| 1,657,842 | * | 1/1928 | Polson | 30/417 |
| 5,692,309 | * | 12/1997 | Pereira | 30/417 |
| 5,787,592 | * | 8/1998 | Lai | 30/418 |
| 5,794,353 | * | 8/1998 | Lin | 30/418 |

FOREIGN PATENT DOCUMENTS

| | | | | |
|---|---|---|---|---|
| 0503931 | * | 9/1992 | (EP) | 30/426 |
| 2161449 | | 7/1984 | (GB) . | |
| 2170172 | | 1/1985 | (GB) . | |

* cited by examiner

*Primary Examiner*—M. Rachuba
*Assistant Examiner*—Dominic Troiano
(74) *Attorney, Agent, or Firm*—Leydig, Voit & Mayer

(57) ABSTRACT

A can opener includes an elongate body, a lever hinged to the body for relative pivotal movement about a horizontal axis between open and closed positions, and a turning knob at a front end of the body. The can opener includes a traction wheel supported for rotation by the turning knob, turning a can, a rotary cutting disk rotatable by the knob for opening the can while the can is being turned, and a mounting plate rotatably supporting the cutting disk. The mounting plate is movable by the lever to slide linearly between a rearward position corresponding to the open position in which the cutting disk is spaced from the traction wheel and a forward position corresponding to the closed position in which the cutting disk is close to the traction wheel.

6 Claims, 4 Drawing Sheets

CAN OPENER

SUMMARY OF THE INVENTION

According to the invention, there is provided a can opener comprising a elongate body, a lever connected to the body for relative pivotal movement about a substantially horizontal axis between open and closed positions, a turning knob provided at a front end of the body, a traction wheel supported for rotation about a substantially vertical axis by the knob to turn a can, a rotary cutter rotatable by the knob for opening said can while said can is being turned, and a slider supporting the rotary cutter for rotation, said slider being movable by the lever to slide linearly between a rearward position corresponding to the lever's open position in which the rotary cutter is away from the traction wheel and a forward position corresponding to the lever's closed position in which the rotary cutter is close to the traction wheel.

Preferably, the slider is movable by the lever through a cam action.

More preferably, the slider has a hole and the lever has a part engaging movably with the hole for sliding the slider in opposite directions upon said pivotal movement of the lever.

It is preferred that the body has an open side facing the lever for receiving the side of the lever facing the body when the lever is in the closed position.

In a preferred embodiment, the lever is resiliently biassed apart from the body towards the open position by means of a spring.

More preferably, one of the body and lever has a resiliently biassed hook and the other of the body and lever has a hole for the hook to releasably engage through, thereby holding the lever in the closed position against the action of the spring.

It is preferred that the turning knob has a vertical shaft and the slider is guided for sliding movement by means of a support fixed on the shaft.

In a specific construction, the turning knob has a vertical shaft on which a co-axial driving sprocket is mounted fast, and the rotary cutter is rotatable with a co-axial driven sprocket which is engageable with the driving sprocket for drive transmission when the lever reaches the closed position.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
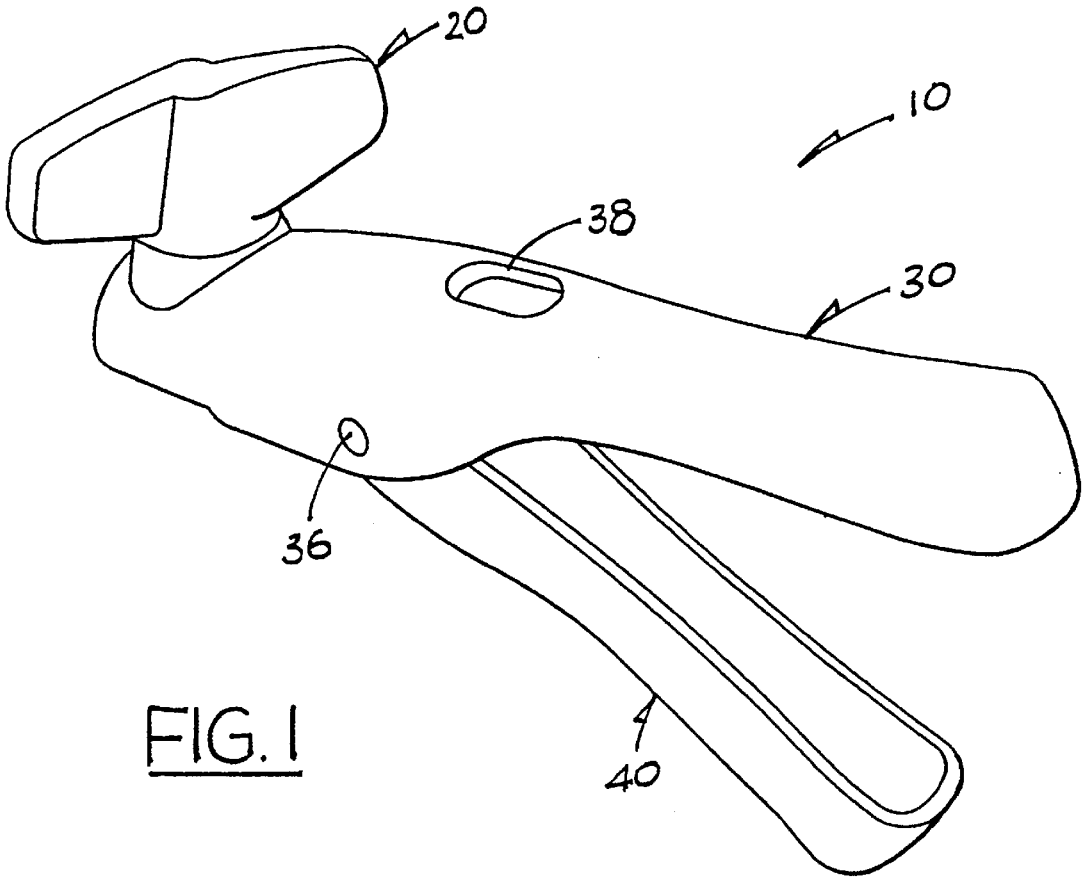
FIG. 1 is a top and rear end perspective view of an embodiment of a can opener (hinged open) in accordance with the invention.
Figure 2:
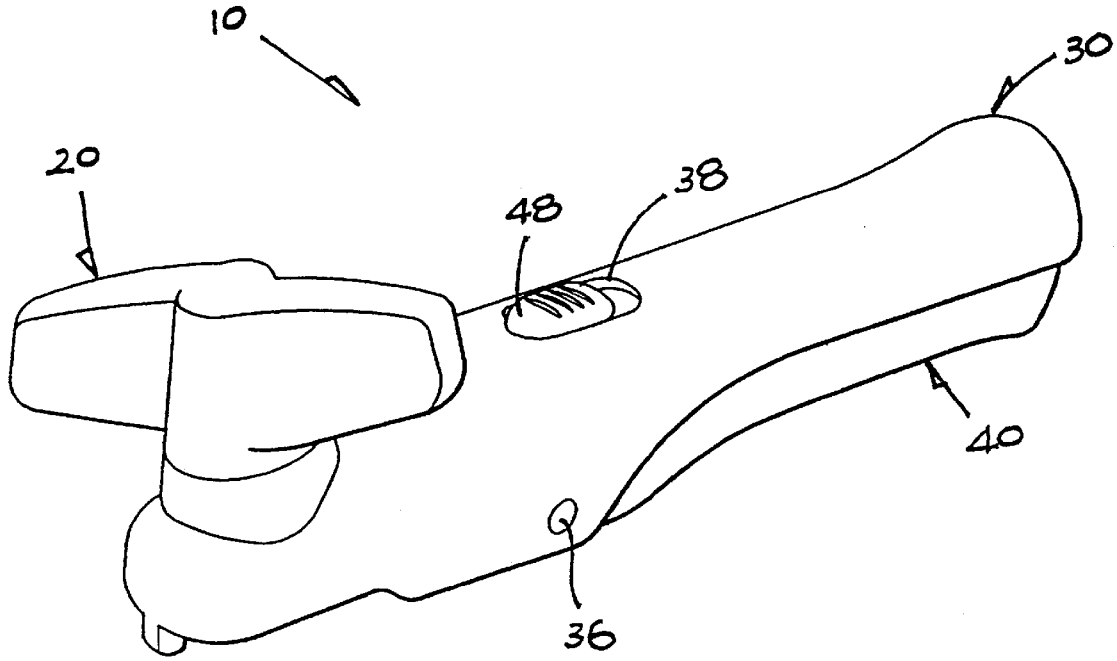
FIG. 2 is a top and front end perspective view of the can opener (hinged closed) of FIG. 1.
Figure 3:
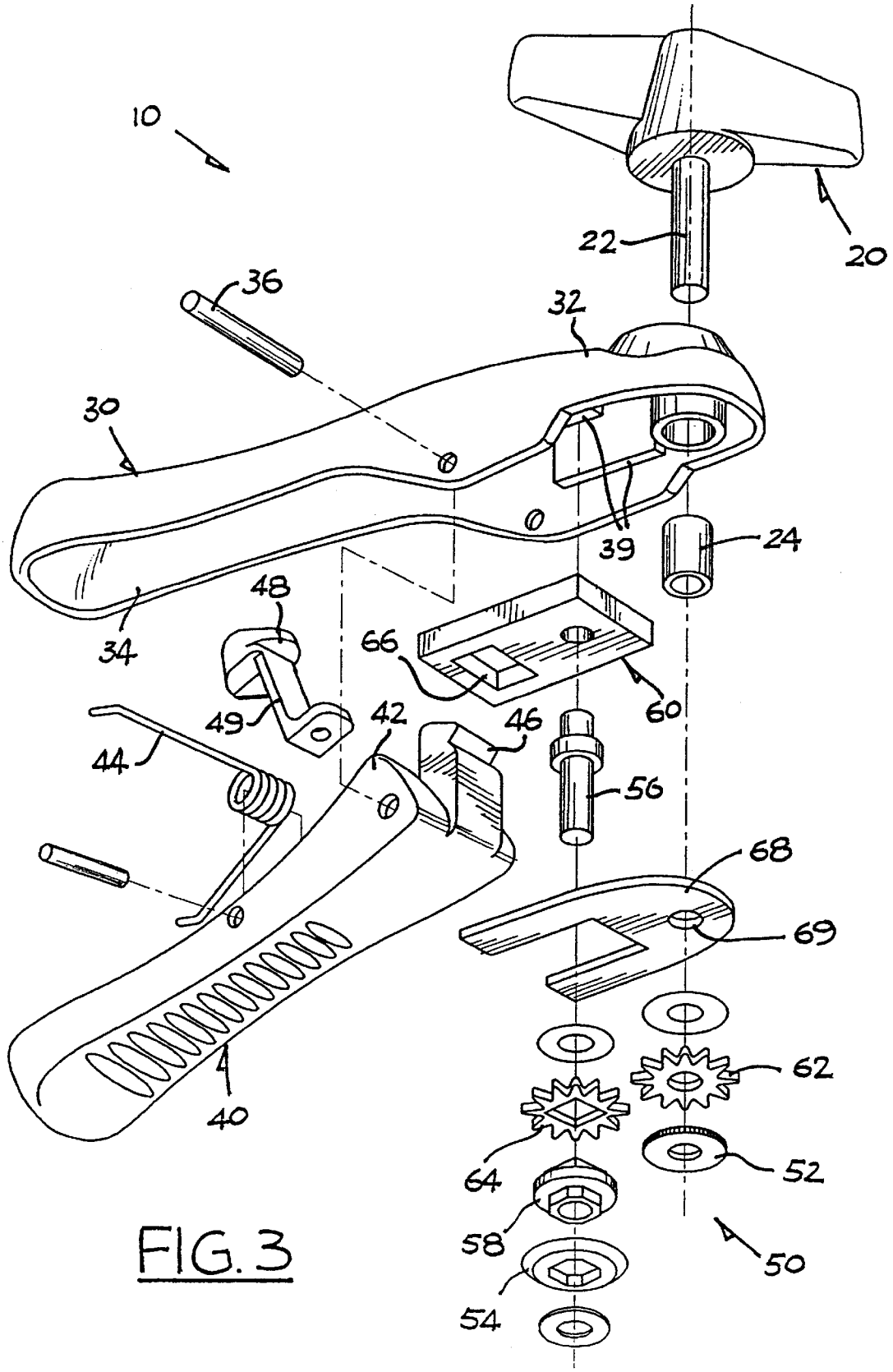
FIG. 3 is an exploded bottom and front end perspective view of the can opener of FIG. 1.
Figure 5:
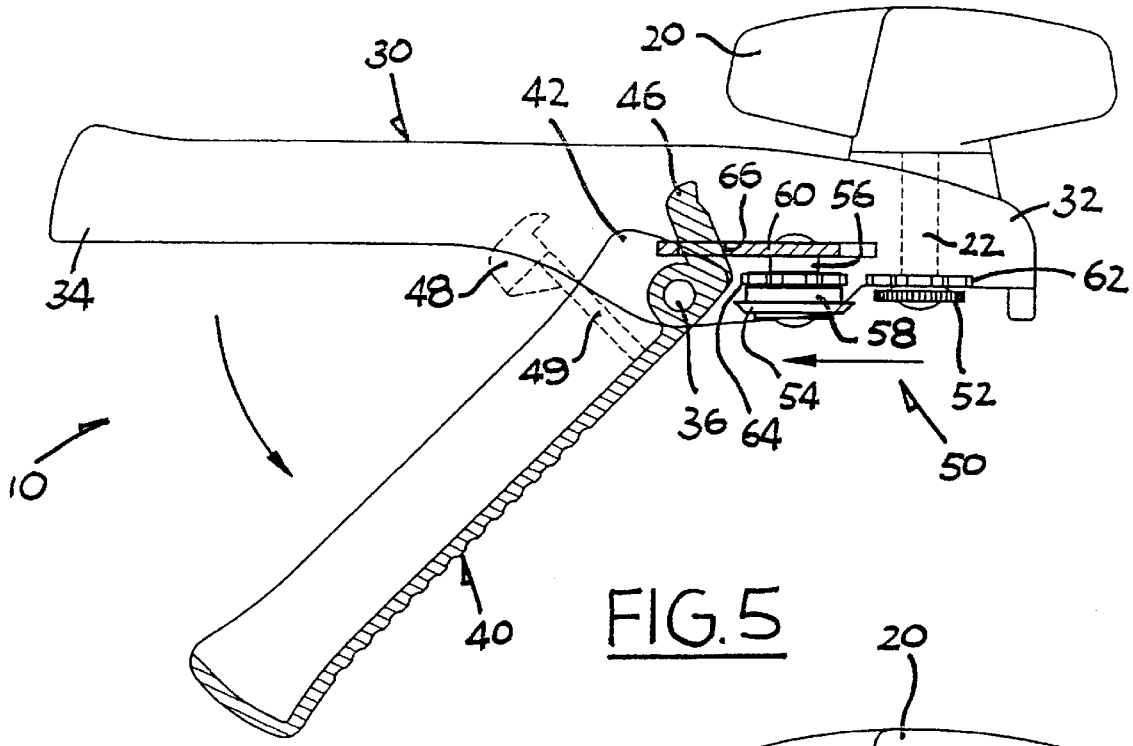
FIG. 5 is a cross-sectional side view of the can opener (hinged open) of FIG. 1.
Figure 6:
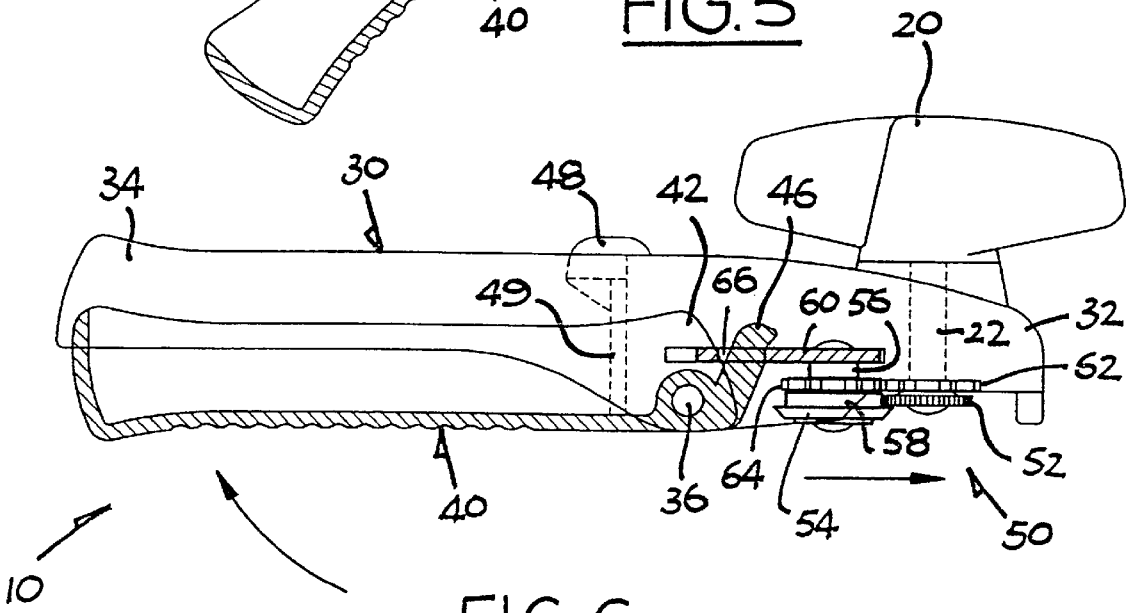
FIG. 6 is a cross-sectional side view of the can opener (hinged closed) of FIG. 2.

Referring to the drawings, there is shown a can opener 10 embodying the invention, which can opener 10 comprises a horizontal elongate hollow body 30 having front and rear ends 32 and 34 and includes a hollow lever 40 below the body 30. The body 30 and the lever 40 have respective open bottom and top sides. A horizontal hinge pin 36 is provided extending across opposite side walls of the body 30 at an intermediate position between the body front and rear ends 32 and 34. The lever 40 is hinged, at its front end 42, to the body 30 by means of the pin 36 for relative pivotal movement about a horizontal axis between a downward open position (FIGS. 1 and 5) and an upward closed position (FIGS. 2 and 6). In the closed position, the open top side of the lever 40 is received within and enclosed by the open bottom side of the body 30.

An elbow spring 44 is supported by the lever 40 for acting against the body rear end 34 in order to bias the lever 40 towards its open position. The body rear end 34 and the lever 40 together form a handle for the overall can opener 10. A winged turning knob 20, which is rotatable about a vertical axis, is provided atop the body front end 32.

Figure 4:
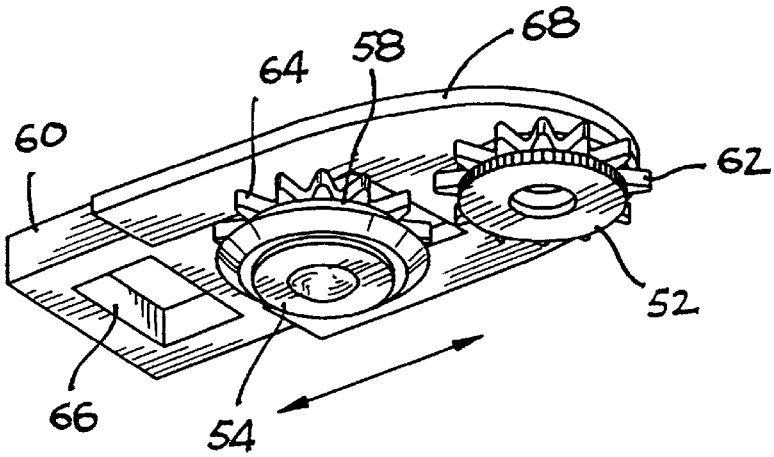
FIG. 4 is a bottom perspective view of a front end of the can opener of FIG. 1.

The can opener 10 includes a cutting mechanism 50 provided at the bottom side of the body front end 32, said mechanism 50 being formed by a traction wheel 52 and a rotary cutting disc 54. The traction wheel 52 is connected co-axially to the knob 20 by means of a vertical shaft 22 for rotation by the knob 20. The cutting disc 54 is rotatably supported on a vertical spindle 56 which is fixed from below to the front end of a mounting plate 60 and spaced rearwardly apart from the shaft 22. The mounting plate 60 is slidable linearly forward to move the cutting disc 54 close to the traction wheel 52 (for cutting operation) and rearward to move the cutting disc 54 away therefrom (FIG. 4). When the cutting disc 54 is moved close to the traction wheel 52, its cutting edge will overlap slightly from below with the traction wheel 52.

Figure 7:
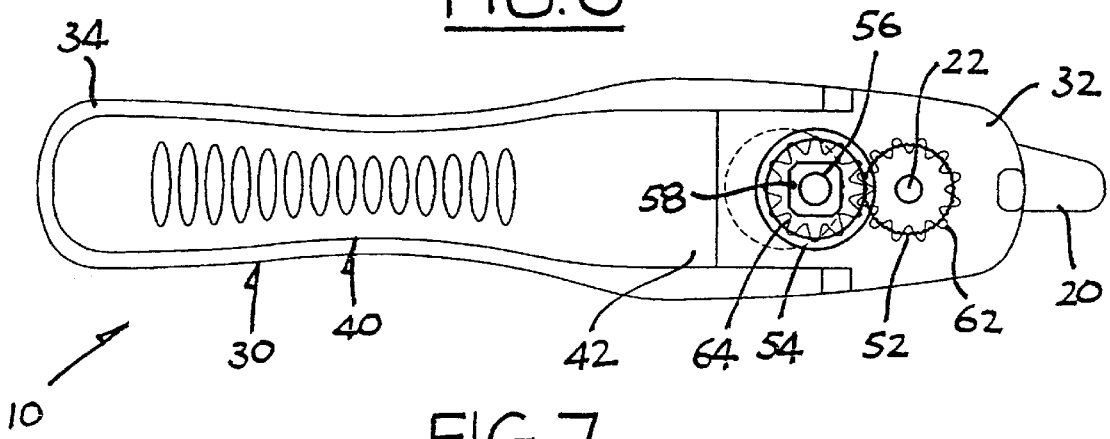
FIG. 7 is a bottom plan view of the can opener (hinged closed) of FIG. 6.

A driving sprocket 62 is mounted fast on the shaft 22 above the traction wheel 52, for rotation by the knob 20 at the same time as the traction wheel 52. A driven sprocket 64 and a co-axial coupler 58 are rotatably supported on the spindle 56 above the cutting disc 54. The coupler 58 engages the driven sprocket 64 above and the cutting disc 54 below together for simultaneous rotation about the spindle 56. Upon sliding forward, the mounting plate 60 also moves the driven sprocket 64 into gear engagement with the driving sprocket 62 (FIG. 7) for drive transmission, thereby enabling the driving sprocket 62 to rotate the driven sprocket 64. The driven sprocket 64 disengages from the driving sprocket 62 when the mounting plate 60 slides rearward.

The mounting plate 60 is disposed between and guided for sliding movement by a pair of side walls 39 depending from inside the body 30 above and a horizontal supporting plate 68 below. The supporting plate 68 has a front hole 69, through which the shaft 22 extends, and is fixed in vertical position by means of a tubular spacer 24 on the shaft 22 above it and the driving sprocket 62 below it.

The pivotal movement of the lever 40 is arranged to effect the sliding movement of the mounting plate 60. For this purpose, the hinged end 42 of the lever 40 is in the form of an upward tongue 46 which engages, from below, movably through a hole 66 formed at the rear end of the mounting plate 60. The tongue 46 will pivot forward when the lever 40 is pivoted upward into the closed position, thereby sliding the mounting plate 60 forward through a cam action. In turn, the mounting plate 60 brings the driven sprocket 64 into engagement with the driving sprocket 62 and also the cutting disc 54 close to the traction wheel 52. Upon downward pivoting of the lever 40 into the open position, its tongue 46 will pivot backward to slide the mounting plate 60 back through a reverse cam action, thereby moving the driven sprocket 64 off the driving sprocket 62 and the cutting disc 54 off the traction wheel 52.

Figure 8:
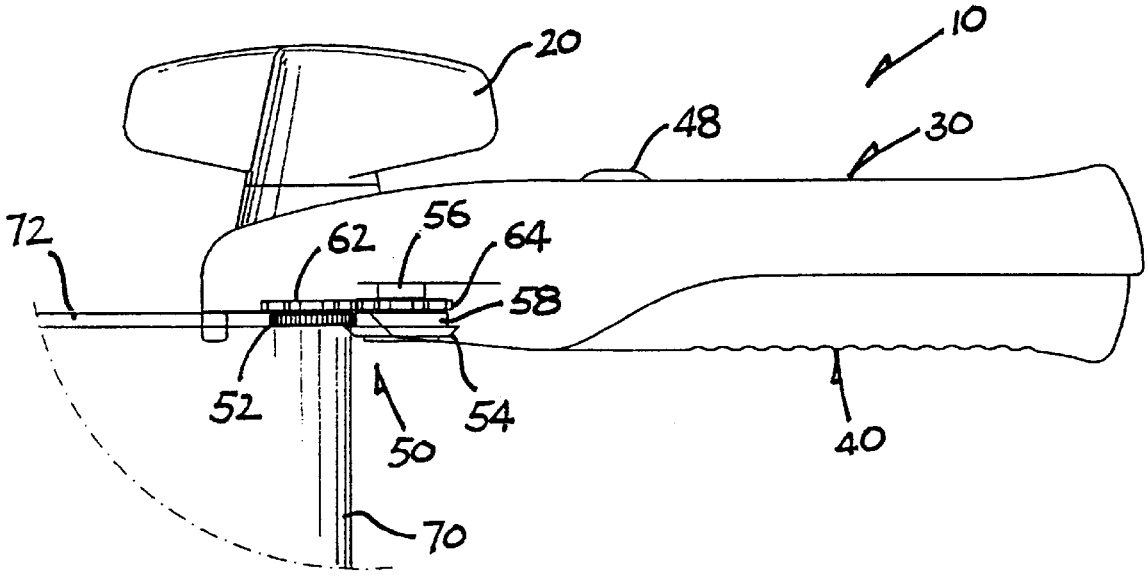
FIG. 8 is an opposite side view of the can opener (hinged closed) of FIG. 6, opening a can.

For opening a can 70 having a top seam 72 (FIG. 8), the can opener 10 is initially placed atop the can 70 such that its traction wheel 52 and cutting disc 54 are positioned inside and outside the seam 72 respectively. The lever 40 is then pivoted closed by squeezing the can opener handle tight, thereby causing the cutting disc 54 to cut into the side wall of the can 70 immediately below the seam 72. At the same time, the traction wheel 52 bears against the inner side of the seam 72, while the coupler 58 bears against the outer side. By means of the turning knob 20, the traction wheel 52 is rotated to turn the can 70 relative to the can opener 10, with the cutting disc 54 simultaneously rotating to cut open the can side wall around immediately below the seam 72.

Upon release, the lever 40 will be sprung open by the spring 44. The lever 40 is provided with a hook 48 which is connected to the inside of the lever 40 by means of a resilient web 49. The hook 48 is arranged to automatically engage the corresponding side of a hole 38 formed in the top wall of the body 30 through a latch action, when the lever 40 is pivoted upward, to hold the lever 40 closed for storage against the action of the spring 44. The hook 48 is made in the form of a sliding knob such that it can be disengaged, upon sliding back, from the hole 38 to release the lever 40 from the body 30 for use.

The invention has been given by way of example only, and various modifications of and/or alterations to the described embodiment may be made by persons skilled in the art without departing from the scope of the invention as specified in the appended claims.

What is claimed is:

1. A can opener comprising:

an elongate body, a lever connected to said body for relative pivotal movement about a first axis between open and closed positions, a spring resiliently biasing said lever from said body towards the open position, a turning knob located at a front end of said body, a traction wheel supported for rotation about a second axis substantially perpendicular to the first axis by the knob to turn a can, a rotary cutting disk rotatable by the knob for opening the can while the can is being turned, and a mounting plate rotatably supporting said cutting disk, said mounting plate being movable by said lever to slide linearly between a rearward position corresponding to the open position in which said rotary cutting disk is remote from said traction wheel and a forward position corresponding to the closed position in which said rotary cutting disk is close to said traction wheel, wherein one of said body and said lever has a resiliently biased hook and the other of said body and said lever has a hole for releasable engagement by said hook for holding said lever in the closed position against resilient biasing of said spring.

2. The can opener as claimed in claim 1, wherein said body has an open side facing said lever for receiving a side of said lever facing said body when said lever is in the closed position.

3. The can opener as claimed in claim 1, wherein said turning knob has a shaft and said mounting plate is guided for sliding movement by a support fixed on said shaft.

4. The can opener as claimed in claim 1, wherein said lever has said resiliently biased hook, and said body has an open first side facing said lever and a second side opposite the first side, the hole being disposed on the second side of said body.

5. The can opener as claimed in claim 4, wherein said resiliently biased hook engages the hole by extending through the hole and engaging a surface of said body facing away from said lever.

6. The can opener as claimed in claim 1 further including a first sprocket coaxially attached to said turning knob and a second sprocket coaxially attached to said rotary cutting disk, wherein said first and second sprockets engage each other for rotation of said rotary cutting disk by rotation of said turning knob when said mounting plate is in the forward position.

* * * * *